US005260013A

United States Patent [19]

Samuelson

[11] Patent Number: 5,260,013

[45] Date of Patent: Nov. 9, 1993

[54] SHEATH-CORE SPINNING OF MULTILOBAL CONDUCTIVE CORE FILAMENTS

[75] Inventor: Harry V. Samuelson, Chadds Ford, Pa.

[73] Assignee: E. I. Du Pont de Nemours and Company, Wilmington, Del.

[21] Appl. No.: 982,602

[22] Filed: Nov. 25, 1992

Related U.S. Application Data

[60] Division of Ser. No. 695,372, May 3, 1991, Pat. No. 5,202,183, which is a continuation-in-part of Ser. No. 356,051, May 22, 1989, abandoned.

[51] Int. Cl.[5] ..... B29C 47/12; D01F 1/09; D01F 8/04

[52] U.S. Cl. ..... 264/105; 264/171; 264/177.13

[58] Field of Search ..... 264/104, 105, 171, 177.13

[56] References Cited

U.S. PATENT DOCUMENTS 2,936,482 5/1960 Kilian ..... 425/463
3,803,453 4/1974 Hull ..... 361/220

*Primary Examiner*—Leo B. Tentoni

[57] ABSTRACT

Multilobal core conductive bicomponent sheath-core filaments are provided and methods for making the same.

3 Claims, 1 Drawing Sheet

SHEATH-CORE SPINNING OF MULTILOBAL CONDUCTIVE CORE FILAMENTS

This is a division of application Ser. No. 07/695,372, filed May 3, 1991, now U.S. pat. No. 5,202,183 issued Apr. 13, 1993, which is a C.I.P. of Ser. No. 07/356,051 filed May 22, 1989, now abandoned.

BACKGROUND OF THE INVENTION

Synthetic filaments having antistatic properties comprising a continuous nonconducting sheath of synthetic polymer surrounding a conductive polymeric core containing carbon black have been taught by Hull in U.S. Pat. No. 3,803,453. The cross-section of the core shown in said patent is circular. Need has arisen in certain end-use applications, such as career apparel worn in clean rooms, for even greater reduction of static propensity, and contrary to the desires expressed by others to conceal the fiber blackness, is a desire for greater visibility of the core.

Sheath-core filaments wherein the cross-section of the core is trilobal are known. They can be prepared with a spinneret of the type shown in U.S. Pat. No. 2,936,482. While useful products of the invention can be prepared with such spinnerets, improvements in preserving definition of the trilobal core through the spinning process is a worthwhile objective. The present invention offers an improved spinning technique as well as providing a novel filament which rapidly dissipates electrical charges.

SUMMARY OF THE INVENTION

The present invention has two important aspects. It provides a novel synthetic filament having antistatic properties comprising a continuous nonconductive sheath of a synthetic thermoplastic fiber-forming polymer surrounding an electrically conductive polymeric core comprised of electrically conductive carbon black dispersed in a thermoplastic synthetic polymer, the cross-section of said core having from three to six lobes and a modification ratio of at least 2, with each lobe having an L/D ratio of from 1 to 20, where L is the length of a line drawn from the center point of the line between low points of adjacent valleys on either side of the lobe to the farthest point on said lobe, and D is the greatest width of the lobe as measured perpendicular to L. It also provides an improved process for better maintaining the core definition during melt-spinning of a sheath-core fiber wherein one polymer composition constitutes the sheath component and a different polymer composition constitutes the core component and in which the core has three or more lobes. The process comprises simultaneously extruding the molten sheath and core component compositions through a spinning orifice with the sheath component completely surrounding the core component, the improvement comprising, maintaining the core cross-sectional configuration by 1) feeding the molten core component composition in the desired multilobal cross-section through a channel opening above a spinneret capillary, 2) feeding the molten sheath component from all directions against the core along the periphery of the entrance to the spinneret capillary to completely surround the core component, 3) controlling the flow of molten sheath component composition at spaced sections along the periphery of the spinneret capillary entrance to allow more to flow to zones between the lobes than to zones at the lobes, and 4) solidifying the molten components after leaving the spinneret orifice.

DETAILED DESCRIPTION OF THE INVENTION

Figure 1:
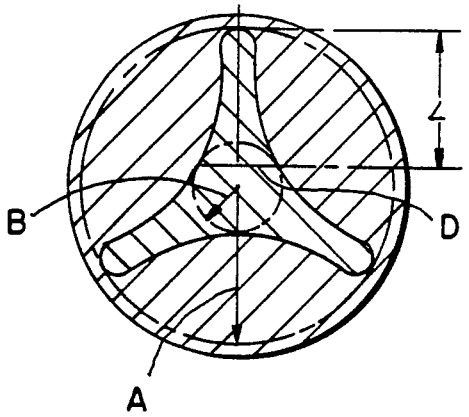
FIGS. 1 and 2 are schematic cross-sectional views of sheath-core filament of the invention illustrating trilobal and tetralobal cores as well as showing how the required structural parameters are determined.

Static dissipating fibers are well-known in the art and have been used for many years in textiles. A particularly successful fiber has been the fiber described in U.S. Pat. No. 3,803,453. This fiber is a sheath-core bicomponent fiber prepared by melt co-extrusion of two thermoplastic compositions as sheath and core, respectively. The sheath is nonconductive. The core polymer is made conductive by incorporation of electrically conductive carbon black. The sheath provides strength to the fiber, hides the black core, and protects the core against chipping and flaking which can occur if the core were exposed at the fiber surface. Certain present day end-use applications require greater anti-static effect with less concern for color. In distinction, there is a greater desire to see more core color as a means of distinguishing in use those garments which are protected from those which are not. Applicants have found that this can be accomplished by modifying the sheath-core fiber of U.S. Pat. No. 3,803,453. The modification consists primarily of employing a core, of the same composition as in said patent but having a cross-section with from three to six lobes, a modification ratio of at least 2, and with each lobe having an L/D ratio of from 1 to 20. FIG. 1 shows such a cross-section.

FIG. 1 is a schematic cross-sectional representation of a sheath-core fiber wherein a trilobal core is surrounded by a sheath as might be seen on an enlargement of a photomicrograph. The nature of the core and sheath will be discussed in greater detail below. The determination of modification ratio is known in the art but, for convenience, it can be defined by reference to FIG. 1. The modification ratio is the ratio of the radius of the smallest circle circumscribing the trilobal core to the radius of the largest circle which can be inscribed in the trilobal core where the lobes meet. In FIG. 1, this is A/B.

Figure 2:
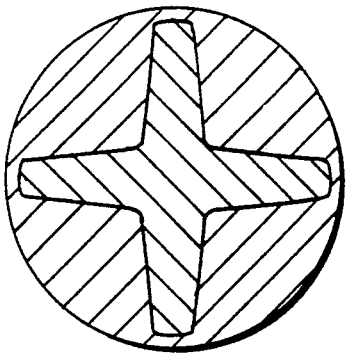

Determination of the L/D ratio for the lobes is also illustrated by reference to FIG. 1. A first line is drawn connecting the low points of adjacent valleys on either side of a lobe and another line L is drawn from the center of the first line to the farthest point of said lobe. The value D represents the greatest width of the lobe as measured perpendicular to L. FIG. 2 is a schematic showing a cross-section of a round fiber having a tetralobal core.

Spinning of the filaments of the invention can be accomplished by conventional two-polymer sheath-core spinning equipment with appropriate consideration for the differing properties of the two components. The filaments are readily prepared by known spinning techniques and with polymers as taught, for example, in U.S. Pat. No. 2,936,482. Additional teaching of such spinning with polyamides is found in U.S. Pat. No. 2,989,798. A new improved process has been developed to better preserve the definition of sheath-core bicomponent fibers having tri-, tetra-, penta- or hexalobal cores as they are extruded. This is described below.

Figure 3:
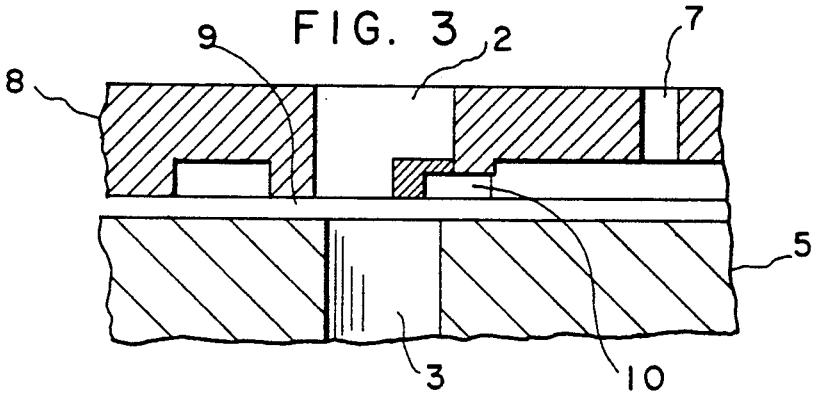
FIG. 3 is a fragmentary section of a distribution and spinneret plate taken along line 3,3 of FIG. 4.
Figure 4:
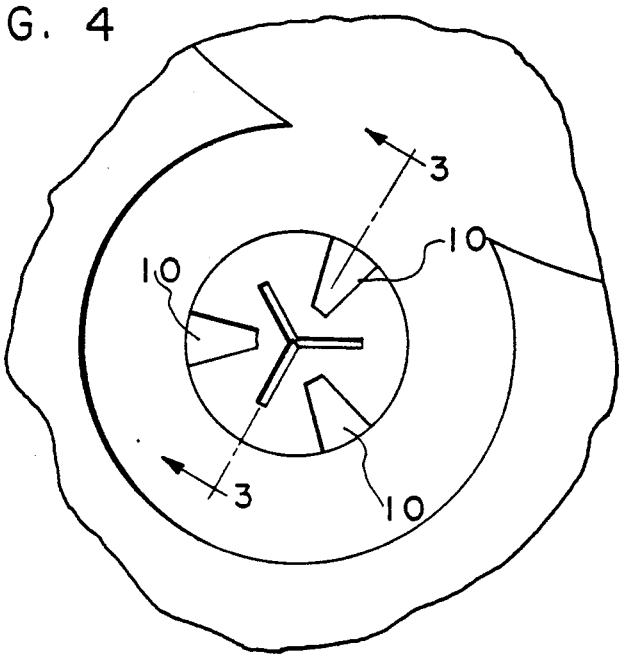
FIG. 4 is a bottom view of the distribution plate of FIG. 3.

The improved process employed for spinning the sheath-core bicomponent yarn of Examples 1 and 2 below, is a modification of a conventional sheath-core bi-component melt-spinning process. In the conventional process, the core feed polymer stream and the sheath feed polymer stream are fed to a spinneret pack including filters and screens, and to a plate which distributes the molten polymer streams to orifices that shape the core and surround it with sheath. Reference to FIGS. 3 and 4 will assist in the understanding of the modified process. Core polymer is fed to channel 2 and exits over the entrance to capillary 3 of spinneret plate 5. Sheath polymer is fed through passageway 7 of plate 8 into the space between plates 5 and 8, maintained by shims not shown. This polymer is fed from all directions against the core polymer stream in the vicinity of the entrance to the spinneret capillary 3 and both streams pass through capillary 3 in sheath-core relation, finally exiting from the spinneret orifice, not shown, at the exit of capillary 3. The improved process maintains better definition of the core lobes. This is accomplished by controlling the flow of molten sheath component composition against the core polymer stream at spaced sections along the periphery of the entrance to the capillary to allow more sheath polymer to flow to zones between the lobes than to zones at the lobes. This can be achieved by enlarging the passageway for the sheath polymer to the capillary only in those sections leading to zones between lobes. Thus, as shown in FIGS. 3 and 4, depressions 10 were etched in plate 8 to permit increased sheath polymer flow to regions between lobes.

The filament sheath may consist of any extrudable, synthetic, thermoplastic, fiber-forming polymer or copolymer. This includes polyolefins, such as polyethylene and polypropylene, polyacrylics, polyamides and polyesters of fiber-forming molecular weight. Particularly suitable sheath polymers are polyhexamethylene adipamide, polycaprolactam, and polyethylene terephthalate.

Tensile and other physical properties of the filaments of the invention are primarily dependent on the sheath polymer. For high strength filaments, polymers of higher molecular weight and those permitting higher draw ratios are used in the sheath. While undrawn filaments of the invention may provide adequate strength for some purposes, the drawn filaments are preferred. In some applications, for example where the filaments of the invention are to be subjected to high temperature processing with other filaments such as in hot fluid jet bulking or other texturing operations, it is important that the sheath polymer have a sufficiently high melting point to avoid undue softening or melting under such conditions.

The filament core of the antistatic fibers consists of an electrically conductive carbon black dispersed in a polymeric, thermoplastic matrix material. The core material is selected with primary consideration for conductivity and processability as described in detail in U.S. Pat. No. 3,803,453. Carbon black concentrations in the core of 15 to 50 percent may be employed. It is found that 20 to 35 percent provides the preferred level of high conductivity while retaining a reasonable level of processability.

The core polymer may also be selected from the same group as that for the sheath, or it may be non-fiber forming, since it is protected by the sheath. In the case of non-antistatic fibers, the core of the bicomponent fiber will, of course, be non-conductive.

The cross-sectional area of the core in the composite filament need only be sufficient to impart the desired antistatic properties thereto and may be as low as 0.3 percent, preferably at least 0.5 percent and up to 35 percent, by volume. The lower limit is governed primarily by the capability of manufacturing sheath/core filaments of sufficiently uniform quality while maintaining adequate core continuity at the low core volume levels.

Conventional drawing processes for the filaments can be used but care should be exercised to avoid sharp corners which tend to break or damage the core of the antistatic fibers. In general, hot drawing, i.e., where some auxiliary filament heating is employed during drawing, is preferred. This tends to soften the core material further and aid in drawing of the filaments. These antistatic filaments may be plied with conventional synthetic, undrawn filaments and codrawn.

For general applications, the filaments of this invention have a denier per filament (dpf) of less than 50 and preferably less than 25 dpf.

The filaments of this invention are capable of providing excellent static protection in all types of textile end uses, including knitted, tufted, woven and nonwoven textiles. They may contain conventional additives and stabilizers such as dyes and antioxidants. They may be subjected to all types of textile processing including crimping, texturing, scouring, bleaching, etc. They may be combined with staple or filament yarns and used as staple fibers or as continuous filaments.

Said filaments may be combined with other filaments or fibers during any appropriate step in yarn production (e.g., spinning, drawing, texturing, plying, rewinding, yarn spinning), or during fabric manufacture. Care should be taken to minimize undesirable breaking of the antistatic filaments in these operations.

Upon exiting the spinneret orifice, the bicomponent stream cools and begins to solidify. It is generally not desirable to apply too high a spin stretch with the conductive fibers since quality as an antistatic fiber diminishes. This is not a limitation with other bicomponent fibers.

TEST PROCEDURES

Tenacity and elongation of yarns were measured using ASTM D-2256-80. The method for determining relative viscosity (LRV) of polyester polymers is described in U.S. Pat. No. 4,444,710 (Most). The method for determining relative viscosity (RV) of polyamides is disclosed in U.S. Pat. No. 4,145,473 (Samuelson). Surface resistivity of fabrics is determined using AATCC Test Method 76-1987. Electrostatic propensity of carpets is measured using AATCC Test Method 134-1986. Static decay data are measured using Method 4046 (Mar. 13, 1980), Federal Test Method Std. No. 101C. The modification ratios and L/D ratios were measured from cross-sections on photomicrographs as well understood in the art.

The following examples, except for controls, are intended to illustrate the invention and are not to be construed as limiting. Multilobal core filaments of the invention are described in each of Examples 1 to 3.

EXAMPLE 1

Sheath-core filaments having a sheath of 23.5 LRV polyethylene terephthalate and a polyethylene core that contained 28.4% carbon black were spun and wound up without drawing at 1200 meters per minute. The conducive core constituted 6% by weight of these filaments, and the yarns, which contained six filaments, were subsequently heated to 140° C. and drawn at the ratios listed in Table I. Samples with a round conductive core were spun using a spinneret assembly similar to that shown in FIG. 11 of U.S. Pat. No. 2,936,482, whereas those having trilobal shaped cores were spun by the improved process of this invention using the spinneret assembly and plate shown in FIGS. 3 and 4. The modification ratio of the trilobal conductive core was 5 and the L/D ratio was 3. The trilobal core yarns were darker than the round core yarns. After drawing, these yarns were incorporated into a 100% polyester 28 cut jersey knit by feeding in the conductive core yarns at 5/16 inch intervals. Yarn and fabric properties measured on these samples are shown in Table I:

TABLE I

| | Core Shape | |
|---|---|---|
| | Round | Trilobal |
| Draw Ratio | 2.35X | 2.10X |
| Total Denier | 35.9 | 40.0 |
| Tenacity, g/d | 1.81 | 1.61 |
| % Elongation | 28.9 | 21.4 |
| Fabric Properties | | |
| Surface Resistivity ohms/unit sq. | $1.5 \times 10^{13}$ | $1.9 \times 10^{12}$ |
| Federal Test Method 4046 Standard 101C (90% Decay) Time in sec./2 sec. charge level | | |
| From: −5KV | 33/900 | 0.23/275 |
| −5KV | 9.5/−950 | 0.20/−300 |

The fabric containing the yarn with the trilobal shaped conductive core had significantly lower surface resistivity and much faster static decay times than that made with the yarns having round conductive cores.

EXAMPLE 2

Sheath-core filamentary yarns (40 denier 6 filaments) having a sheath of 46 RV 66-nylon and either round or trilobal shaped conductive cores similar to those described in EXAMPLE 1 were prepared, except they were drawn at 110° C. using a 3.2X draw ratio. The modification ratio of the trilobal conductive core was 4 and the L/D ratio was 2. These conductive core fibers were plied with 1225 denier nylon carpet yarn and direct tufted into level loop carpets. Both carpets were evaluated in the AATCC Test Method 134. The carpet containing the yarns with trilobal shaped cores had a significantly lower measurement of 0.8 KV versus 1.2 KV for the carpet made from yarns having round conductive, cores.

EXAMPLE 3

Utilizing spinneret assemblies as described in FIG. 11 of U.S. Pat. No. 2,936.482, sheath-core products were produced having a 24% central conductive core surrounded by a 76% sheath of polyethylene terephthalate. Filaments having either round or trilobal (modification ratio of 2.0, L/D of 1.0) shaped conductive cores were prepared, and the cores contained 32.0% carbon black ("Vulcan P", available from Cabot Corp.), compounded into a film grade equivalent high melt index, low density polyethylene.

The resulting fibers were air quenched at 21° C., drawn 1.84X and wound up at 1372 meters per minute as a 35 denier 6 filament product. After heat annealing (130° C.) to reduce shrinkage, the products were woven into fabric for static dissipation evaluation.

Woven fabrics were prepared as follows:

Non-Conductive Yarns - 150 denier, 34 filaments - 3.3Z twist polyester fiber.
Static Dissipative Yarns - 100 denier, 34 filaments - 4S twist polyester fiber plus one static dissipative yarn as described above.
Weaving:
96 ends, 88 picks, 8 x 8 herringbone
Warp - 1 Static dissipative yarn and 23 non-conductive ends.
Filling - 2 Static dissipative yarns and 22 non-conductive picks.
Fabrics:
A. Contains Trilobal Core
B. Contains Round Core
Electrostatic Properties
Yarn Resistivity, ohms/cm (length)-as prepared.
A. $3.7 \times 10^{11}$
B. $7.4 \times 10^{11}$
Fabric Resistivity (AATCC 76-1987) ohms/unit square after heat-setting and scouring
A. warp-$2.9 \times 10^{12}$, fill-$2.7 \times 10^{12}$
B. warp-$1 \times 10^{14}$, fill-$[illegible] \times 10^{13}$

EXAMPLE 4

Sheath-core filaments were prepared with polyethylene terephthalate sheath and trilobal shaped conductive cores made from carbon black dispersed in polyethylene as described in Example 1, and which constituted 12% by weight of the filaments. These yarns were spun at 600 meters/minute, and then in a separate step they were drawn to a 3x draw ratio over a 110° C. hot plate, and wound up at 300 meters/minute so that the final yarn denier-yarn count was 40-6. Sample C was spun with the spinneret pack described in Example 1, while sample D was spun with the same spin pack except that the small cutouts in the plateau which increased polymer flow into the trilobal saddle were absent. The trilobal shaped core in sample C had a modification ratio of 3.0 and a L/D of 1.4, whereas the core in sample D had a 1.5 modification ratio and a L/D of 0.6. Plain woven fabrics were prepared as follows:

Non-conductive yarns - 70 denier, 34 filament polyester
Weaving - 110 ends/inch (warp), 76 picks/inch (fill), with 2 of the static dissipative yarns inserted in the fill direction after every 34 non-conductive picks.

The woven fabrics were after-scoured and rinsed to remove all residual finish, and then tested using a corona discharge test in which cut samples from the fabrics were placed on a grounded metal plate and charged to 10,000 volts using a 10,000 volt corona. Then the residual electric field intensities were measured two seconds after charging to determine the residual charge. When the woven fabric containing sample C (having trilobal core with 3.0 modification ratio) was tested, the residual charge was 750 volts/inch, while the woven fabric containing sample D (1.5 modification ratio core) had 2450 volts/inch residual charge, and a plain woven control fabric that lacked any static dissipative yarns had 7000 volts/inch residual charge.

Although the apparatus shown in FIGS. 3 and 4 was used to prepare sample C and the trilobal shaped core samples in Examples 1 and 2, other means can be employed. A thin shim (0.001–0.010 inches) can be placed between the distribution plate and spinneret to control polymer flow axially to the trilobal capillary legs and allow the sheath polymer to flow into the zones between the lobes to maintain the desired shape and thickness.

I claim:

1. In a process for melt-spinning a sheath-core fiber wherein one polymer composition constitutes the sheath component and a different polymer composition constitutes the core component and the core cross-section has three or more lobes, which process comprises simultaneously extruding both molten component compositions, through a spinning orifice with the sheath component completely surrounding the core component, the improvement comprising, maintaining the core cross-sectional configuration by 1) feeding the molten core component composition in the desired multilobal cross-section through a channel opening above a spinneret capillary,
2) feeding the molten sheath component from all directions against the core along the periphery of the entrance to the spinneret capillary to completely surround the core component,
3) controlling the flow of molten sheath component composition at spaced sections along the periphery of the spinneret capillary entrance by enlarging the passageway for the sheath polymer only in those sections leading to zones between lobes to allow more flow to zones between the lobes than to zones at the lobes, and
4) solidifying the molten components after leaving the spinneret orifice to form the sheath-core fiber.

2. A process according to claim 1 wherein the core component composition is electrically conductive.

3. A process according to claim 2 wherein the core component comprises electrically conductive carbon black dispersed in polyethylene.

* * * * *